US005580287A

United States Patent [19]

Wieringa

[11] Patent Number: 5,580,287

[45] Date of Patent: Dec. 3, 1996

[54] ELECTRIC MOTOR DRIVE FOR A BOAT

[75] Inventor: Jeffrey L. Wieringa, San Marcos, Calif.

[73] Assignee: J. W. Outfitters, Inc., San Marcos, Calif.

[21] Appl. No.: 520,913

[22] Filed: Aug. 30, 1995

[51] Int. Cl.[6] ..... B63H 5/10

[52] U.S. Cl. ..... 440/6; 440/62

[58] Field of Search ..... 440/62, 63, 6, 440/7; 114/144 R

[56] References Cited

U.S. PATENT DOCUMENTS

| | | | |
|---|---|---|---|
| 3,052,204 | 9/1962 | Scivally | 440/62 |
| 3,889,625 | 6/1975 | Roller et al. | 440/62 |
| 4,668,195 | 5/1987 | Smith | 440/6 |

*Primary Examiner*—Jesus D. Sotelo

*Attorney, Agent, or Firm*—Law Offices of Thomas E. Schatzel, A Prof. Corporation

[57] ABSTRACT

An electric motor drive comprising an electric motor within a housing and coupled to a propeller; a hollow cylindrical rotatable drive shaft projecting from the housing along a vertical axis of rotation; a boat mount anchoring the drive shaft in place with the drive shaft being rotatable within the boat mount about the vertical axis of rotation; a transmission housing with a rotor engaged to the drive shaft, a directional control cable locked to the rotor with the rotor being rotatable responsive to movement of the control cable; an electric power cable extending through the drive shaft to the electric motor to deliver electric power to the motor; and a control panel with a switch connected to the first electric power cable to control electric power to the electric motor, and a directional control connected to the control cable.

15 Claims, 1 Drawing Sheet

BATTERY

ELECTRIC MOTOR DRIVE FOR A BOAT

BACKGROUND OF THE INVENTION

1. Field of the Invention

The present invention relates to drive systems for boats and more particularly to an electric motor drive for recreational powered water craft.

2. Description of the Prior Art

Water recreation is popular with millions of persons. This includes recreational boats which come within numerous classifications. Such classifications include rafts and small recreational boats such as fishing vehicles. These boats may comprise rigid hulls or inflatable boats that may be carried to remote water bodies and then inflated for use. Many such boats are then manually propelled by oars, paddles, etc.

Frequently, it is necessary that the sports person carry such boats, e.g. on their back like a back pack. Thus, it is necessary that the structure be as light weight and small as is reasonable and possible.

In the prior art, inflatable pontoon boats have evolved to be of relatively light weight and packable into compact configurations for manual transport. However, there is a need for a power source to power the boats. Such a power source need be of light weight, readily packable into compact packages and operable from a source of energy which is also of light weight and readily packable into a compact package. Also, the system need be resistant to corrosion; easily assembled without the need of many, if any, tools; and require minimal field maintenance.

SUMMARY OF THE PRESENT INVENTION

It is therefore an object of the present invention to provide a motor drive for a boat that is of light weight.

It is another object of the present invention to provide a motor drive for a boat that is readily mountable to and removable from a boat without the need of many tools.

It is another object of the present invention to provide a motor drive for a boat that is readily packable into a compact configuration.

It is another object of the present invention to provide a motor drive for a boat that is corrosion resistant.

It is another object of the present invention to provide a motor drive for a boat that requires minimal field maintenance.

A preferred embodiment of the present invention includes an electric motor drive comprising an electric motor within a housing and coupled to a propeller; a hollow cylindrical rototable drive shaft with a first terminal end engaged to and projecting from the housing along a vertical axis of rotation; a boat mount to engage to a boat frame support and anchoring the drive shaft in place with the drive shaft being rotatable within the mount about the vertical axis of rotation; a transmission housing with a rotor engaged to the drive shaft and rotatable about the axis of rotation and with a directional control cable locked to the rotor such that the rotor rotates responsive to movement of the cable, an electric power cable extending through the drive shaft to the electric motor to deliver electric power to the motor from a battery and a control panel with switch means connected to the electric power cable to control electric power to the motor, and a directional control connected to the control cable to control movement of the cable.

An advantage of the present invention is that it provides a motor drive for a boat that is light weight.

Another advantage of the present invention is that it provides a motor drive for a boat that is readily mountable to and removable from a boat without the need of many tools.

Another advantage of the present invention is that it provides a motor drive for a boat that is readily packable into a compact configuration.

Another advantage of the present invention is that it provides a motor drive for a boat wherein the components may comprise of corrosion resistant materials.

Another advantage of the present invention is that it provides a motor drive for a boat that requires minimal field maintenance.

These and other objects and advantages of the present invention will no doubt become obvious to those of ordinary skill in the art after having read the following detailed description of the preferred embodiments which are illustrated in the various drawing figures.

IN THE DRAWINGS

DESCRIPTION OF THE PREFERRED EMBODIMENT

Figures 1, 2, 3:
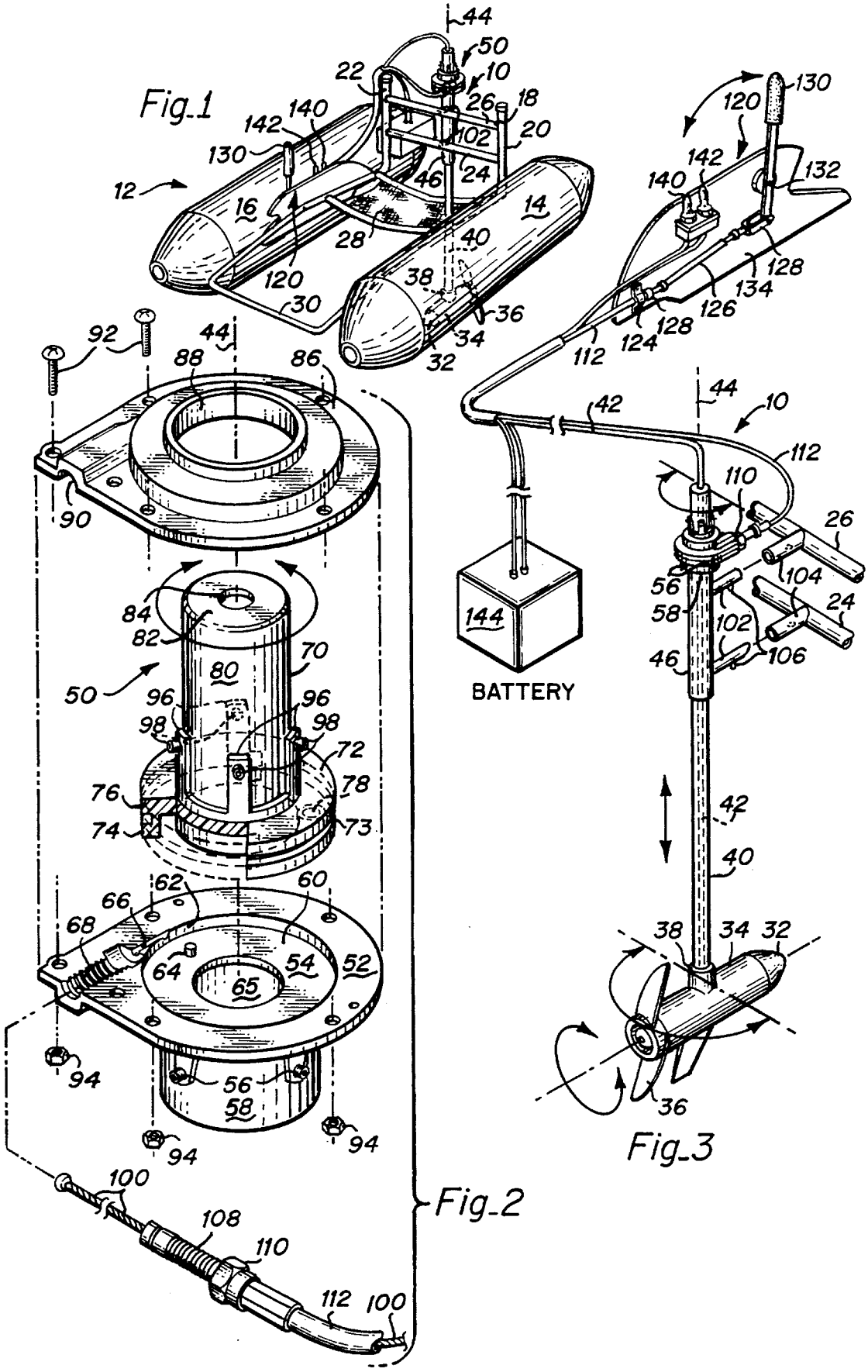
FIG. 1 is a perspective view of an electric motor drive for a boat of the present invention and illustrated as mounted on a pontoon boat.
FIG. 2 is an exploded view of the transmission assembly of the drive system of FIG. 2.
FIG. 3 is a perspective view of the motor drive system of FIG. 1 as separated from a boat.

FIGS. 1–3 illustrate an electric motor drive system of the present invention and referred to by the general reference character 10. FIG. 1 illustrates the motor drive system 10 mounted on a floatation device, e.g. pontoon boat generally used for recreational purposes and referred to by the general reference character 12. The floatation device 12 includes a pair of pontoon members 14 and 16, illustrated in ghost lines, with a frame assembly 18 extending between and secured to the pontoon members 14 and 16. The frame assembly 18 includes a pair of vertical supports 20 and 22 connected to a pair of horizontal supports 24 and 26. The frame assembly 18 further includes a horizontal seat 28 with a foot bar 30 to support an occupant.

The motor drive system 10 as illustrated in FIGS. 1–3 includes an electric motor 32 with a housing 34 and a propeller 36 projecting from one end of the housing 34. A cylindrical stud 38 projects laterally from the housing 34 to receive a hollow cylindrical drive shaft 40. The hollow drive shaft 40 is sealed to the electric motor 32 within the stud 38 such that an electric power cable 42 within the drive shaft 40 extends within the interior of the housing 34. Likewise, rotational movement of the drive shaft 40 results in rotational movement of the electric motor 32 about a vertical axis of rotation 44 to provide direction control of the boat 12.

The cylindrical hollow drive shaft 40 extends through a vertical housing 46 which is coaxial with the axis 44 such that the drive shaft 40 rotates within the housing 46. Engaged about a terminal end of the vertical housing 46 is a transmission subassembly referred to by the general reference character 50 and illustrated in an exploded view in FIG. 2. The transmission subassembly 50 includes a bottom cover 52 which forms an internal cylindrical cavity 54 coaxial about the axis 44. The bottom cover 52 is secured to the vertical housing 46 by means of four locking fasteners 56 which penetrate through a sleeve 58 superimposed over the vertical housing 46 about the terminal end of the vertical housing 46. The cavity 54 is formed by a circular bottom wall 60 integral with a vertical circular wall 62. Protruding from the bottom wall 60 is a stud 64. The bottom wall 60 has a central aperture 65 through which the drive shaft 40 protrudes. Tangentially aligned with the cavity 54 and intersecting the wall 62 is a cable receiving groove 66 in axial alignment with a threaded semi-arcuate groove 68.

In coaxial alignment with the bottom cover 52 is a rotor 70 having a disk 72 about one end. The disk 72 has an outer wall 73 of a diameter consistent with that of the cavity 54 such that the disk 72 may sit and rotate within the cavity 54 about the axis of rotation 44. Within the bottom surface of the disk 72 is an arcuate groove 74 which extends approximately two hundred degrees around the lower surface of disk 72. The groove 74 is positioned to be in alignment with the stud 64 when the disk 72 is placed within the cavity 54. The interface relationship of the groove 74 and stud 64 limits the total rotational movement of the drive shaft 40 and motor 32 to approximately two hundred degrees about the axis of rotation 44.

Also surrounding the periphery of the disk 72 in wall 73 is an exterior groove 76 for receiving a drive cable. The groove 76 extends around the entire circumference of the disk 72. Vertically intersecting the disk 72 and the groove 76 is an anchor pin 78 for anchoring a drive cable to the disk 72.

The rotor 70 includes a hollow cylinder 80 projecting vertically from the disk 72 along the axis of rotation 44. The internal diameter of the cylinder 80 coincides with the external diameter of drive shaft 40. The cylinder 80 terminates in an end wall 82 which has a central opening 84 along the axis of rotation 44.

The transmission subassembly 50 further includes a top cover 86 having a central opening 88 through which the cylinder 80 projects along the axis of rotation 44. The top cover 86 further includes a threaded semi-arcuate groove 90 which mates with the groove 68 when the top cover 86 is properly positioned relative to the bottom cover 52 and secured in place by a plurality of fasteners 92 bolted in place with lock nuts 94. The opening 88 is of a circumference greater than that of the cylinder 70 such that a support wall formed by a plurality of prongs 96 slide within the interior of the aperture 88 and are rotatable thereabout.

The drive shaft 40 is anchored to the rotor 70 by four lock pins 98 positioned approximately ninety degrees apart. The pins 98 penetrate through the support walls 96 to within the interior of the rotor 70 and in interface locking positions with the surface of the drive shaft 40. Therefore, as the rotor 40 rotates about the axis 44 and the stationary covers 52 and 86, the drive shaft 40 also rotates about the axis 44.

A directional control cable 100 extends through an opening formed by the grooves 68 and 90, and the cable receiving groove 66 and wraps around the disk 72 within the groove 76 with the end anchored by the anchor pin 78. Thus, linear motion of the control cable 100 results in rotation of the rotor 70 about the axis of rotation 44. When the cable 100 extends, the rotor 70 rotates clockwise. When the cable 100 is retracted, the rotor 70 rotates counter-clockwise. With the top cover 86 being secured to the lower cover 52 and the lower cover being secured to the vertical housing 46, the rotor 50 is free to rotate about the axis of rotation 94 within covers 52, 86 and housing 46.

To secure the housing 46 in place to the boat 12, a pair of studs 102 project laterally from the housing 46 to engage the frame assembly 18. The frame assembly 18 includes two female sleeves 104 projecting from the cross members 24 and 26 and adapted to receive the studs 102 and then be locked in place by the locking pins 106. Consequently, when the studs 102 are inserted within the sleeves 104 and locked in place, the housing 46 is likewise locked in place to the frame assembly 18 of the pontoon boat 12. Other means of securing the motor to the boat 12 may include clamps, push button receivers or permanent screws.

Control of the direction of the motor 32 and drive shaft 40 is realized through the directional control cable 100. The cable 100 is secured in place to the transmission assembly 50 by means of threaded sleeve 108 which sits within the cable receiving groove formed by the arcuate segments 90 and 68. Thus, with the covers 86 and 94 secured in place, the sleeve 108 is likewise secured in place and any longitudinal movement of the sleeve 108 is restricted by a locking nut 110 which is rotatable about an exterior shield 112 of the cable 100 and abuts the covers 52 and 86 about the end of the receiving groove formed by the segments 68 and 90. The cable 100 is thus freely movable longitudinally within the shield 112 which is locked in place to the transmission assembly 50. The other terminal end of the shield 112 is anchored in place to a control panel referred to by the general reference character 120. The control panel 120 includes a plate 122 which has an anchoring strap 124 engaged to and about the external end of the shield 112. Thus, opposite terminal ends of the shield 112 are anchored at the transmission subassembly 50 and at the control panel 120. Extending from the anchor 124 is an inner lock piston 126 fitting within a cylinder 128 with the piston 126 being tied to the terminal end of the directional control cable 100. The other terminal end of the piston 126 is tied to an inner link 128 engaged to a terminal end of a directional control lever 130. The directional control lever 130 is engaged at approximately its mid point to the panel plate 122 by a pin 132. Therefore, the lever 130 can rotate clockwise and counter-clockwise about the pin 132 while engaged to the piston 126 through the inner link 128. Thus, as the lever arm 120 is moved clockwise, it causes the cable 100 to extend and therefore pushes the rotor 70 clockwise. When the lever 130 is urged in a counter-clockwise direction, it causes the cable 100 to retract and therefore turns the rotor 70 and the drive shaft 40 in a counter-clockwise direction.

Electrical power to the motor 32, is accomplished by means of the power cable 42 which extends through the hollow shaft 40, the cylinder 80 and the aperture 84 to a power switch means having two switches 140 and 142 at the control panel 120. The switch 140 is an on-off switch to control power to the motor 32, and the switch 142 is a polarity switch to control the direction of rotation of the motor 32, and thus forward or reverse direction of the boat 12. The power cable then extends from said switches to a battery 144. Therefore, with the power switch 140 turned on, electric power is then delivered through the switch 140 and 142 through the cable to the motor. Likewise, depending upon the polarity position of the switch 142, the motor propeller 36 is either driven in a clockwise direction or counter-clockwise direction depending upon the choice of direction in which the pontoon boat 12 is to be delivered.

The degree of rotation of the shaft 40 about axis 44 is restricted by the interface of the stud 64 within the groove 74. With the groove 74 being limited to approximately two hundred degrees, when the rotor 70 rotates to its extremity, it interfaces with the stud 64 which prevents further rotational movement. Likewise, the transmission assembly 50 may be comprised of rust-proof components, for example, plastic materials. These components can be manufactured from injection molding processes. Therefore, they are economical to manufacture while being rust-proof and lightweight. Likewise, the sleeve 46 may also be comprised of a plastic material and the drive shaft 40 may be comprised of an aluminum material coated with an anti-rust material. As a result, the entire drive assembly is very lightweight, portable, very easy to assemble to the boat and very easy to operate merely through control of the lever 130 and two power switches 140 and 142.

Although the present invention has been described in terms of the presently preferred embodiment, it is to be understood that such disclosure is not to be interpreted as limiting. Various alterations and modifications will no doubt become apparent to those skilled in the art after having reading the above disclosure. Accordingly, it is intended that the appended claims be interpreted as covering all alterations and modifications as fall within the true spirit and scope of the invention.

I claim:

1. Electric motor drive (10) comprising, in combination:

an electric motor (32) within a housing (34) and coupled to a propeller (36) projecting from said housing (34);

a hollow cylindrical rotatable drive shaft (40) with a first terminal end engaged to and projecting from said housing along a vertical axis of rotation (44);

a boat mount means (46) for engaging to a boat frame support and anchoring the drive shaft (40) in place with the drive shaft being rotatable within the mount means about said vertical axis of rotation (44);

a transmission housing (50) including an internal cavity (54) with a rotor (70) positioned within said cavity (54) and engaged to the drive shaft (40) extending through said cavity (54) along said axis of rotation (44) and through a bottom cover anchor (52) connected in place to the boat mount means, said rotor (70) including a disk (72) within said cavity (54) and anchored to a first terminal end of a directional control cable (100) locked to said rotor (70) with said rotor (70) being rotatable responsive to movement of said control cable (100), and a top cover (86) secured to said bottom cover anchor (52) with said internal cavity (54) being formed by said bottom and top covers (52, 86);

a first electric power cable (42) extending through the drive shaft (40) to the electric motor (32) to deliver electric power to the motor (32); and a control panel (120) with switch means (140, 142) connected to the first electric power cable (42) to control electric power to the electric motor (32), and a directional control (130) connected to said control cable (100) to control movement of said control cable (100).

2. The drive of claim 1 wherein, said directional control cable (100) is positioned within an exterior shield (112) and movable lengthwise within said shield (112), a terminal end of said exterior shield is anchored (108, 110) to the transmission housing (50) whereby said directional control cable (100) is movable lengthwise within said exterior shield (112) and said disk (72) rotates about said vertical axis of rotation (44) responsive to lengthwise movement of said directional control cable (100).

3. The drive of claim 2 wherein, the control panel (120) includes power switch means (140, 142) interconnected to a second power cable for interconnection to a battery source (144) and to said first electric power cable (112), and an anchor (124) securing a second terminal end of said exterior shield (112) in place, with a second terminal end of said directional control cable (100) being engaged to said directional control (130).

4. The drive of claim 3 wherein, said control panel (120) further includes an interlock having an outer housing (128) locked to said exterior shield (112), and an inner cylinder (126) within said outer housing (128), said inner cylinder (126) being secured to said second terminal end of said directional control cable (100) and to said directional control (130), wherein movement of said inner cylinder (126) translates into lengthwise movement of said directional control cable (100).

5. The drive of claim 4 wherein, the transmission housing (50) further includes rotational limitation means to limit the rotational movement of said rotor to less than two hundred degrees about said axis of rotation.

6. The drive of claim 5 wherein, said rotational limitation means includes an arcuate groove (74) of less than two hundred degrees with said rotor (70) and a stud (64) projecting from said bottom cover (52) and interfaced within said groove (74), such that said stud (64) interfaces with an end wall of said groove (74) upon said rotor (70) attempting to rotate beyond extremities of said groove (74).

7. The drive of claim 6 wherein, said rotor (70) further includes a vertically projecting hollow cylinder (80) engaged to and coaxial with said disk (72), a second terminal end of the drive shaft (40) is positioned within said vertically projecting hollow cylinder (80), and fasteners (98) for locking the drive shaft (40) to said vertically projecting hollow cylinder (70).

8. The drive of claim 7 wherein, a power cable entrance opening (84) about one end of said vertically projecting hollow cylinder (80) with the electric power cable (42) extending through said power cable entrance opening (84).

9. Electric motor drive (10) comprising, in combination:

an electric motor (32) within a housing (34) and coupled to a propeller (36) projecting from said housing (34);

a hollow cylindrical rotatable drive shaft (40) with a first terminal end engaged to and projecting from said housing along a vertical axis of rotation (44);

a boat mount means (46) for engaging to a boat frame support and anchoring the drive shaft (40) in place with the drive shaft being rotatable within the mount means about said vertical axis of rotation (44);

a transmission housing (50) including an internal cavity (54) with a rotor (70) positioned within said cavity (54) and engaged to the drive shaft (40) extending through said cavity (54) along said axis of rotation (44) and through a bottom cover anchor (52) connected in place to the boat mount means, a directional control cable (100) locked to said rotor (70) with said rotor (70) being rotatable responsive to movement of said control cable (100), and a top cover (86) secured to said bottom cover anchor (52) with said internal cavity (54) being formed by said bottom and top covers (52, 86), said directional control cable (100) being positioned within an exterior shield (112) and movable lengthwise within said shield (112), a terminal end of said exterior shield being anchored (108, 110) to the transmission housing (50) whereby said directional control cable (100) is movable lengthwise within said exterior shield (112) and said rotor (70) rotates about said vertical axis of rotation (44) responsive to lengthwise movement of said directional control cable (100);

a first electric power cable (42) extending through the drive shaft (40) to the electric motor (32) to deliver electric power to the motor (32); and a control panel (120) with switch means (140, 142) connected to the first electric power cable (42) to control electric power to the electric motor (32), and a directional control (130) connected to said control cable (100) to control movement of said control cable (100).

10. The drive of claim 9 wherein, the control panel (120) includes power switch means (140, 142) interconnected to a second power cable for interconnection to a battery source (144) and to said first electric power cable (112), and an anchor (124) securing a second terminal end of said exterior shield (112) in place, with a second terminal end of said directional control cable (100) being engaged to said directional control (130).

11. The drive of claim 10 wherein, said control panel (120) further includes an interlock having an outer housing (128) locked to said exterior shield (112) , and an inner cylinder (126) within said outer housing (128), said inner cylinder (126) being secured to said second terminal end of said directional control cable (100) and to said directional control (130), wherein movement of said inner cylinder (126) translates into lengthwise movement of said directional control cable (100).

12. The drive of claim 11 wherein, the transmission housing (50) further includes rotational limitation means to limit the rotation movement of said rotor to less than two hundred degrees about said axis of rotation.

13. The drive of claim 12 wherein, said rotational limitation means includes an arcuate groove (74) of less than two hundred degrees within said rotor (70) and a stud (64) projecting from said bottom cover (52) and interfaced within said groove (74), such that said stud (64) interfaces with an end wall of said groove (74) upon said rotor (70) attempting to rotate beyond extremities of said groove (74).

14. The drive of claim 13 wherein, said rotor (70) further includes a vertically projecting hollow cylinder (80) engaged to and coaxial with said disk (72), a second terminal end of the drive shaft (40) is positioned within said vertically projecting hollow cylinder (80), and fasteners (98) for locking the drive shaft (40) to said vertically projecting hollow cylinder (70).

15. The drive of claim 14 wherein, a power cable entrance opening (84) about one end of said vertically projecting hollow cylinder (80) with the electric power cable (42) extending through said power cable entrance opening (84).

* * * * *